US006930269B1

(12) United States Patent
Lee et al.

(10) Patent No.: US 6,930,269 B1
(45) Date of Patent: Aug. 16, 2005

(54) QUIET, MEDIUM CURRENT ROCKER SWITCH

(75) Inventors: Davin Robert Lee, Watertown, WI (US); David Mark Nelson, Mequon, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/878,762

(22) Filed: Jun. 28, 2004

(51) Int. Cl.[7] ..... H01H 21/80
(52) U.S. Cl. ..... 200/553
(58) Field of Search ..... 200/6 R–6 C, 200/16 R–16 D, 553, 557–559, 339

(56) References Cited

U.S. PATENT DOCUMENTS 4,024,367 A 5/1977 Kodaira et al.
4,321,442 A 3/1982 Tanaka et al.
4,528,431 A 7/1985 Coleman, III
4,697,053 A 9/1987 Lockard
4,843,195 A * 6/1989 Sato et al. ..... 200/302.3
5,158,172 A * 10/1992 Roeser et al. ..... 200/553
5,436,421 A * 7/1995 Sadowski ..... 200/558
5,810,109 A 9/1998 Chu
6,339,201 B1 1/2002 Balaban et al.
6,459,060 B1 * 10/2002 Bartok ..... 200/553
6,545,239 B2 4/2003 Spedale et al.
6,576,855 B2 6/2003 Levendis et al.
6,590,175 B1 * 7/2003 Lam ..... 200/315
6,794,592 B1 * 9/2004 Liu et al. ..... 200/302.3

* cited by examiner

*Primary Examiner*—Michael A. Friedhofer
(74) *Attorney, Agent, or Firm*—Martin J. Moran

(57) ABSTRACT

A rocker switch for a rocker switch assembly, where the rocker switch assembly has a housing with terminals and defines an enclosed space. The rocker switch includes a handle member and a contactor assembly. The handle member is structured to be pivotally coupled to the housing at a pivot point. The handle member has first and second extensions extending radially from the pivot point, and a plunger extending generally perpendicular to the first and second extensions and radially from the pivot point. The contactor assembly has an elongated conductor and a generally arcuate segment. The contactor assembly is coupled to a terminal within the enclosed space and the plunger engages the arcuate segment.

4 Claims, 9 Drawing Sheets

QUIET, MEDIUM CURRENT ROCKER SWITCH

BACKGROUND OF THE INVENTION

1. Field of the Invention

The present invention relates to a rocker switch and, more specifically, to a rocker switch that is structured to operate without an, or with a minimally, audible click.

2. Background Information

Rocker switch assemblies are well known in the art. A rocker switch assembly generally includes a housing, a handle, a conductor, and at least two buses. The handle is coupled to the housing and mounted on a rotational axis overlying the conductor. The handle includes extensions projecting in generally opposite radial directions from the rotational axis and a plunger extending radially from the rotational axis and generally perpendicular to the extensions. The plunger contacts a rocker actuator that is structured to move the conductor. Alternatively, the plunger may act as the rocker actuator and contact the conductor directly. The conductor is coupled to a first terminal. The second, distal end is located adjacent to a second terminal and is structured to move between a first position, wherein the conductor is spaced from the second terminal, and a second position, wherein the conductor contacts the second terminal. The rocker actuator pivots in a seesaw fashion to move the conductor between the first and second positions. This type of rocker switch has a relatively long opening/closing time and a contact bounce, as well as an audible noise. As such the prior art rocker switches are noisy and prone to overheating and contact degradation. Generally, switches carrying one amp, or more, of current should have a quick opening/closing time and a short contact bounce.

There is, therefore, a need for a rocker switch having a quick opening/closing time and a short contact bounce to prevent overheating and contact degradation.

There is a further need for a rocker switch having a quick opening/closing time and a short contact bounce to be economically manufactured.

There is a further need for a rocker switch having a quick opening/closing time and a short contact bounce to be quiet.

SUMMARY OF THE INVENTION

These needs, and others, are met by the present invention which provides a rocker switch assembly having a handle member and a contactor assembly, wherein the contactor assembly includes a generally arcuate actuator segment. The contactor assembly further includes an elongated, generally stiff, but flexible, conductor. The generally arcuate actuator segment is disposed between the plunger and the conductor, or may be integral to the conductor. Similar to the prior art, the handle member is structured to be rotationally coupled to a housing and includes extensions projecting in generally opposite radial directions from the rotational axis and a plunger extending radially from the rotational axis and generally perpendicular to the extensions. In operation, the handle member plunger contacts the contactor assembly generally arcuate actuator segment. As the handle member rotates, the plunger moves along the arcuate segment and the moveable contact is moved between the first and second positions. The shape of the arcuate segment causes the conductor to move at a slower speed as the plunger moves towards the ends of the arcuate segment while allowing the conductor to move quickly when the plunger is contacting the central portion of the arcuate segment. Thus, the movable contact moves quickly between the first and second positions as the plunger moves along the center portion of the arcuate segment, but does not produce a loud audible noise because the handle member moves slower as the plunger moves to the ends of the arcuate segment.

There are two variations of three types of components that may be combined into one of six embodiments. The variations of the elements include (1) the location of the arcuate segment, i.e. the arcuate segment as being either integral to the conductor body or an arcuate actuator member, (2) the conductor being fixed to a terminal or free to rock, and, (3) the arcuate segment being either a two or three position arcuate segment. The difference between the two embodiments of the first type of component is self explanatory. The second type of component relates to the conductor being coupled to a terminal. In one embodiment, one end of the conductor is coupled to a terminal as set forth above. That is, a first end of the conductor is coupled to a first terminal and the second end of the conductor, which has a contact, is structured, i.e. flex, to move between a first position where the contact is spaced from a second terminal to a second position where the contact engages the second terminal. This is, essentially, a simple switch having an open and a closed position. Alternatively, the conductor may be free at both the first and second ends. In this embodiment, both ends of the conductor have contacts. Thus, the conductor is structured to rock between a first position where the contact at the first end engages a first terminal and a second position where the contact at the second end engages the second terminal. In this embodiment, one terminal is coupled to a load while the other terminal may be connected to a separate load or not connected to a load.

The third type of component, the arcuate segment being either a two or three position arcuate segment, relates to how the arcuate segment causes the conductor to move. With a two position arcuate segment, the arcuate segment has a generally smooth arcuate portion that allows the conductor to move smoothly between the first and second positions. A three position arcuate segment includes a neutral position portion structured to arrest the motion of the conductor between the first and second positions so that neither the first end or the second end engages a terminal. This position is the neutral position. In the embodiment where the arcuate segment is an actuator member, the neutral position portion is, preferably, a flat section on the face of the actuator member that engages the conductor. In the embodiment where the arcuate segment is an integral to the conductor, the neutral position portion is, preferably, a detent located near the middle of the arcuate segment.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
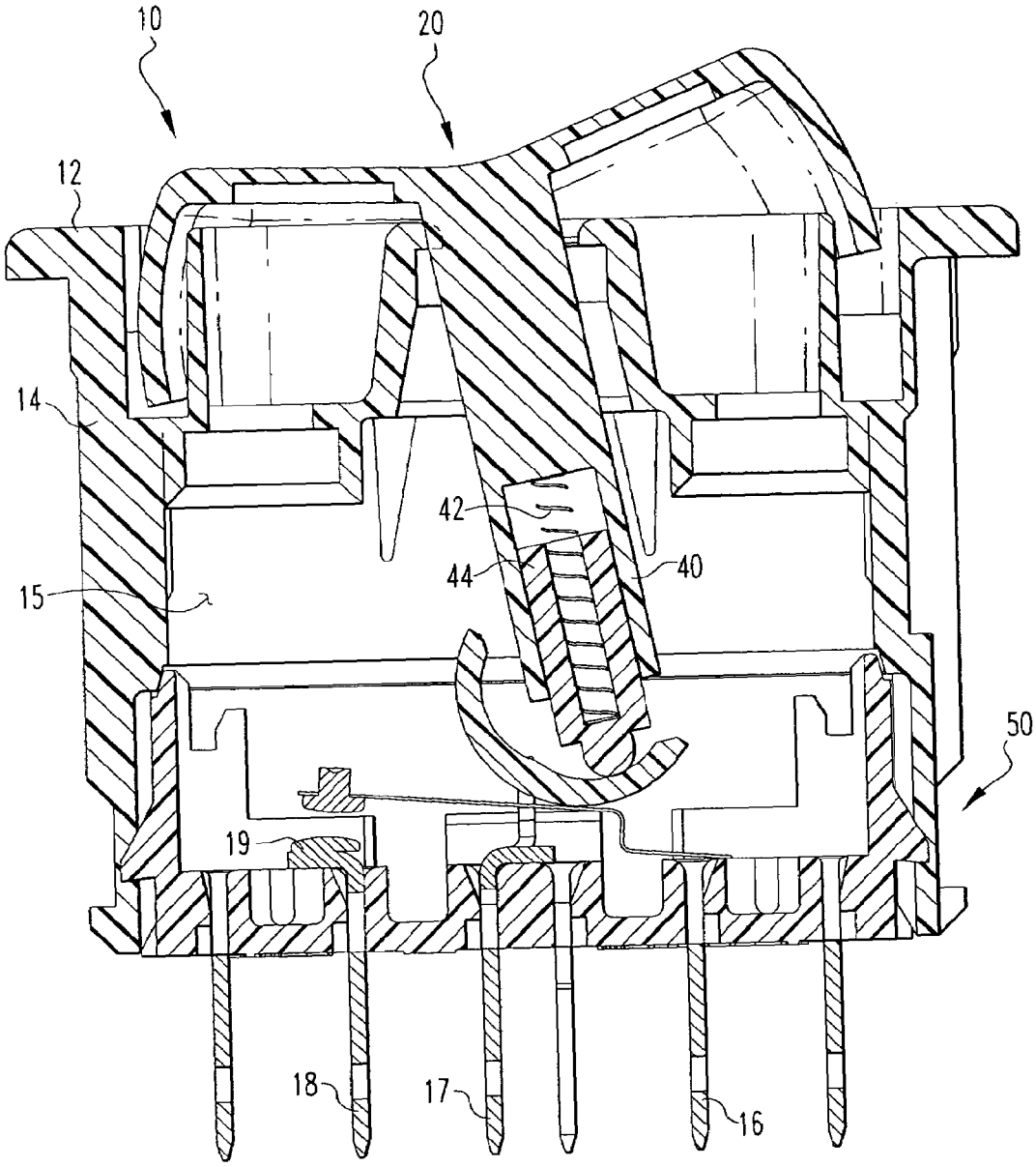
FIG. 1 is cross-sectional side view of a rocker switch assembly.

As shown in FIG. 1, a rocker switch assembly 10 includes a housing assembly 12 and a rocker switch 20. The housing assembly 12 includes a non-conductive housing 14 defining an enclosed space 15 and a plurality of terminals, preferably a first terminal 16, a center terminal 17, and a second terminal 18, and at least one stationary contact 19. Each terminal 16, 17, 18 extends from outside the housing 14 into the enclosed space 15. The first terminal 16 is, typically, coupled to a load or nothing (not shown) and the second terminal 18 is, typically, coupled to a load (not shown). The center terminal 17 is coupled to a line (not shown). At least one terminal includes a stationary contact 19. In this embodiment, the second terminal 18 includes a stationary contact 19 that is structured to engage the movable contact 56 on the conductor (described below).

Figure 2:
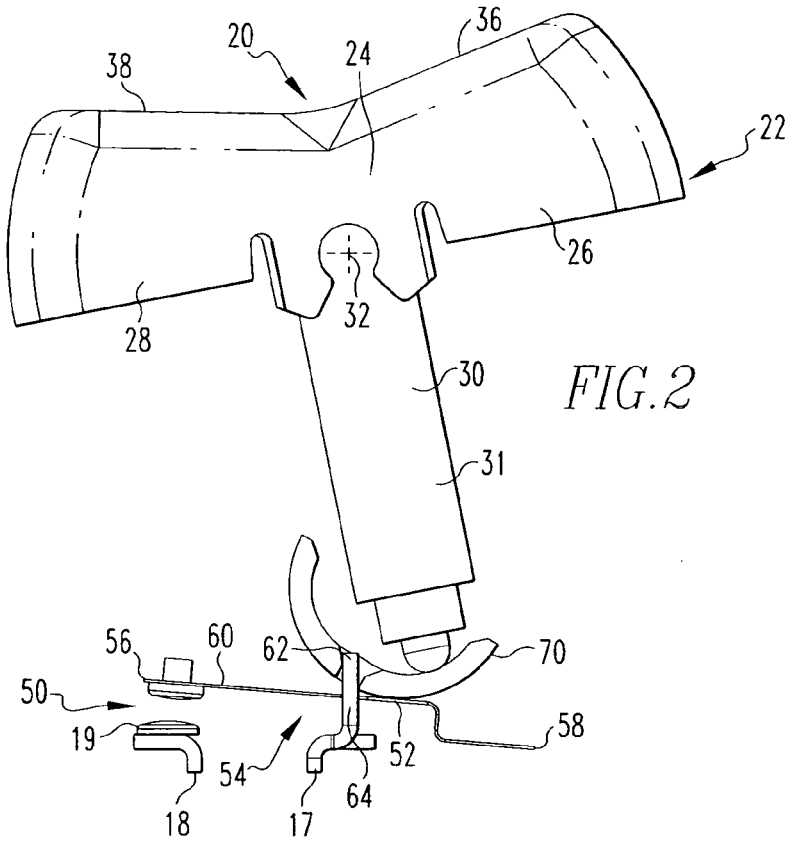
FIG. 2 is a side view of a handle member and a contactor assembly.
Figure 3:
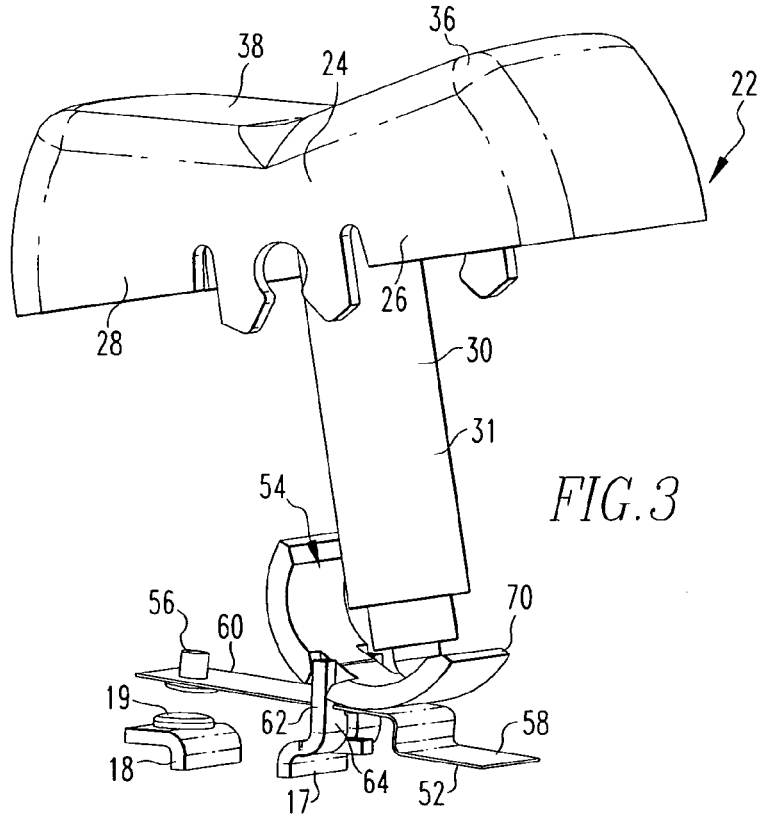
FIG. 3 is an isometric view of a handle member and a contactor assembly.

As shown in FIGS. 2 and 3, the rocker switch 20 includes a handle member 22 and a contactor assembly 50. The handle member 22 has a center portion 24, first and second extensions 26, 28 and a plunger 30. The center portion 24 defines a pivot point 32. The handle member 22 is rotatably coupled to the housing 14 at, and is structured to rotate about, the pivot point 32. The first and second extensions 26, 28 project from the center portion 24 in generally opposite directions and extend radially from the pivot point 32. The plunger 30 extends generally perpendicular to the first and second extensions 26, 28 and extends radially from the pivot point 32. That is, the handle member 22 is generally T-shaped. The upper surfaces 36, 38 of the first and second extensions 26, 28 may be angled for ergonomic or aesthetic reasons. As shown in FIG. 1, the plunger 30, preferably, includes a hollow shaft 40 at the distal end 31 of the plunger 30, a spring 42 and a piston 44. The spring 42 and the piston 44 are disposed within the hollow shaft 40 and structured so that the spring 42 biases the piston 44 away from the pivot point 32. As described below, this configuration ensures that the plunger 30 maintains contact with the contactor assembly 50.

The contactor assembly 50 includes a fixed end elongated conductor 52, an arcuate segment 54, and a movable contact 56. The conductor 52 is rigid, yet flexible, and is preferably made from copper or a copper alloy. In this embodiment, the contactor assembly 50 is configured for use as a two position switch. That is, the conductor 52 has a first end 58 and a second end 60. The movable contact 56 is coupled to the conductor second end 60. The first end 58 is coupled to the first terminal 16 within the enclosed space 15. Typically, in this configuration the first terminal 16 is not connected to a load. The conductor 52 is coupled to the center terminal 17, which is coupled to a line. As shown best in FIG. 3, the center terminal 17 forms a yoke 62 through which the conductor 52 passes, as described below. The conductor 52 contacts the bottom of the yoke 62 at a mounting point 64 and flexes thereon.

Figure 13:
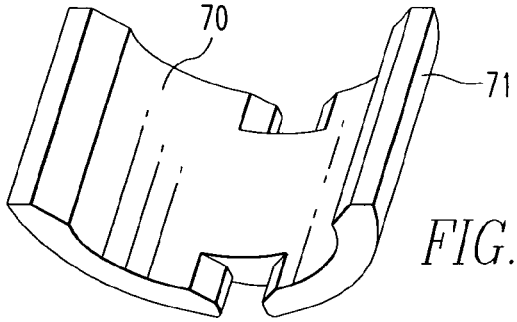
FIG. 13 is a isometric view of an actuator member structured for use in a two position switch.

In this embodiment, the arcuate segment 54 is a two position arcuate actuator member 70 as shown in FIG. 13. The arcuate actuator member 70 is a generally U-shaped having a generally smooth outer face 71. As shown in FIGS. 1–3, when the two position arcuate actuator member 70 is installed, the open side faces toward the plunger 30 and the closed side contacts the conductor 52. The arcuate actuator member 70 is also disposed within the yoke 62. The vertex of the arcuate actuator member 70 is generally disposed within the yoke 62 and the arcuate actuator member 70 is generally symmetrical about the mounting point 64. The shape of the arcuate actuator member 70 is a function of the distance between the pivot point 32 and the arcuate actuator member 70, as well as the angular rotation of the handle member 22.

When assembled, the conductor 52 is disposed within the enclosed space 15 and the conductor first end 58 is coupled to the first terminal 16. The conductor 52 extends through the yoke 62 towards the second terminal 18. The conductor 52 is shaped so that the movable contact 56 is biased to a first position, wherein the movable contact 56 is spaced from the stationary contact 19. The conductor 52 is sufficiently flexible to allow the movable contact 56 to be moved into a second position, wherein the movable contact 56 engages the stationary contact 19. The arcuate actuator member 70 is disposed within the yoke 62 with the vertex of the arcuate actuator member 70 generally disposed at the yoke 62. In this configuration, the arcuate actuator member 70 may move between a first position, wherein the arcuate actuator member 70 is tilted toward the first terminal 16, to a second position, wherein the arcuate actuator member 70 is tilted toward the second terminal 18. Because the arcuate actuator member 70 contacts the conductor 52 at the yoke 62, as the arcuate actuator member 70 moves between the arcuate actuator member 70 first and second positions, the movable contact 56 is moved between the movable contact 56 first and second positions. That is, as the arcuate actuator member 70 moves, the arcuate actuator member 70 contacts the conductor 52 and causes the conductor 52 to flex at the yoke 62.

The handle member 22 is rotatably coupled to the housing 14 at the handle member pivot point 32. The handle member 22 is structured to move, and, more specifically, pivot about the pivot point 32, between a first position, wherein the plunger 30 extends toward the first terminal 16, and a second position, wherein the plunger 30 extends toward the second terminal 18. The plunger 30 extends through the enclosed space 15 towards the arcuate actuator member 70 and the piston 44 contacts the upper surface of the arcuate actuator member 70. The spring 42 ensures that the piston 44 engages the arcuate actuator member 70. When the handle member 22 is in the first position, the plunger 30 biases the arcuate actuator member 70 to the arcuate actuator member 70 first position, and therefore the movable contact 56 is in the first position. As the handle member 22 is moved to the second position, the plunger 30 travels over the upper surface of the arcuate actuator member 70 causing the arcuate actuator member 70 to move into the second position. Accordingly, the movable contact 56 is also moved into the second position. Because the outer face 71 of the two position arcuate actuator member 70 is smooth, the motion between the first an second positions is smooth.

Although the first embodiment was shown as having a fixed end elongated conductor 52, it is understood that the same components, e.g. a two position arcuate actuator member 70, may also be used in conjunction with a rocking conductor 252 as described below.

Figure 4:
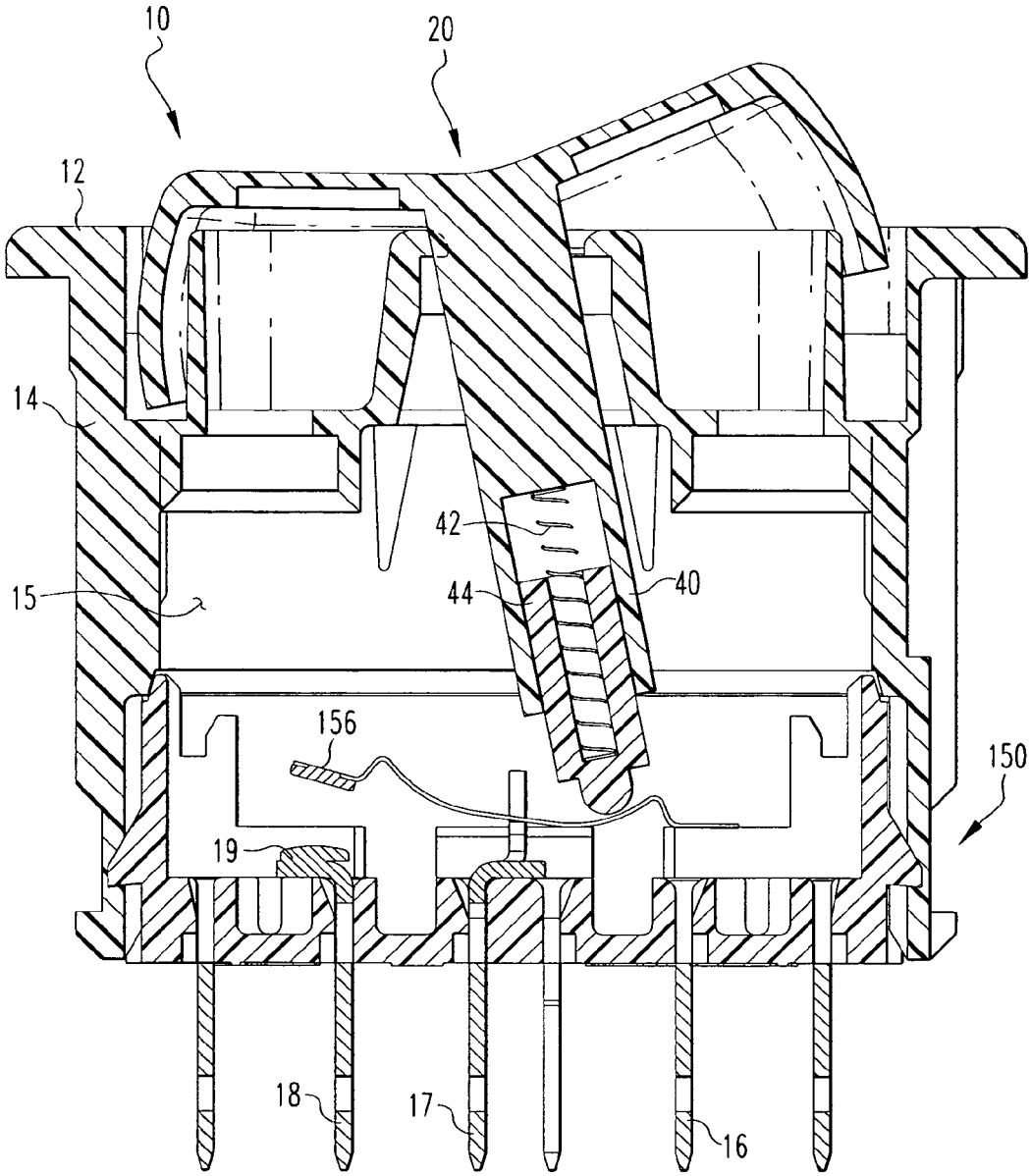
FIG. 4 is cross-sectional side view of an alternate embodiment of a rocker switch assembly.
Figure 5:
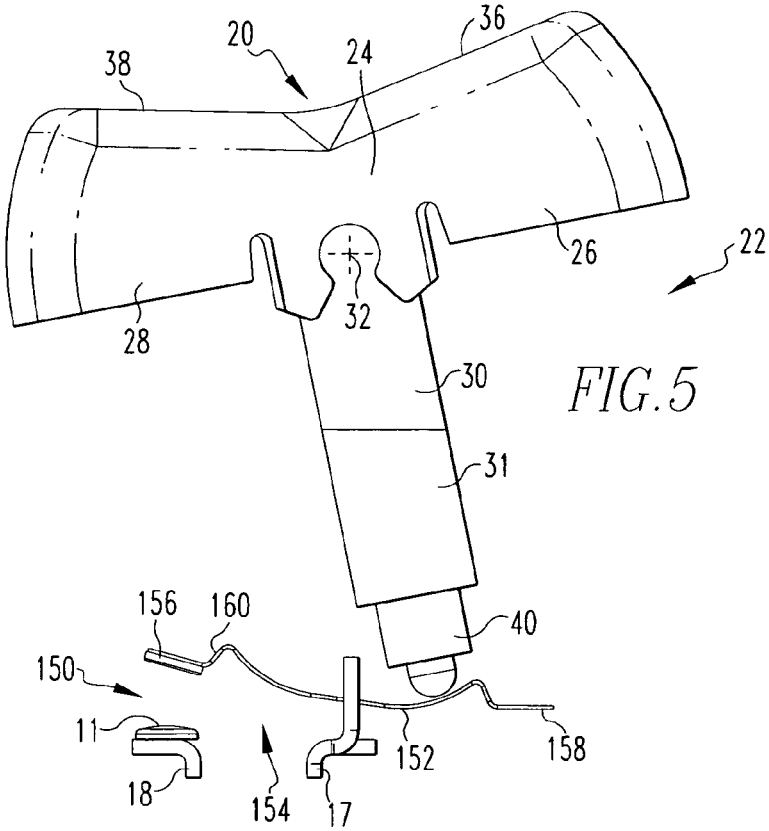
FIG. 5 is a side view of an alternate embodiment of a handle member and a contactor assembly.
Figure 6:
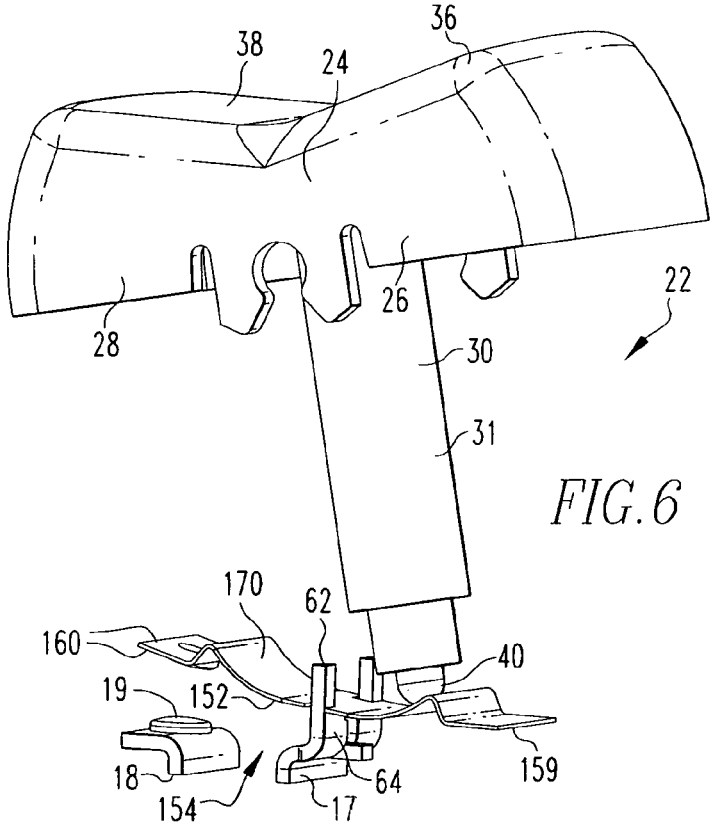
FIG. 6 is an isometric view of an alternate embodiment of a handle member and a contactor assembly.

A second embodiment of the invention is shown in FIGS. 4–6. Generally, the housing assembly 12 and the handle member 22 are substantially similar to the embodiment described above. Accordingly, like reference numbers shall be used to identify the components of the housing assembly 12 and the handle member 22 in the second embodiment. Conversely, the contactor assembly 150 is different, but functionally similar. As such, functionally similar components of the contactor assembly 150 shall be identified by reference numbers that have been increased by 100. Thus, in this embodiment, the contactor assembly 150 includes a fixed end elongated conductor 152, an arcuate segment 154, and a movable contact 156. The conductor 152 is rigid, yet flexible, and is preferably made from copper or a copper alloy. The conductor 152 has a first end 158 and a second end 160. The movable contact 156 is coupled to the second end 160. The first end 158 is coupled to the first terminal 16 within the enclosed space 15. Because the first end 158 is coupled to the first terminal 16, this embodiment is a two-position switch. The conductor 152 is coupled to the center terminal 17. That is, as shown best in FIG. 6, the center terminal 17 forms a yoke 62 through which the conductor 152 passes. The conductor 152 contacts the bottom of the yoke 62 at a mounting point 64 and flexes thereon.

Figure 14:
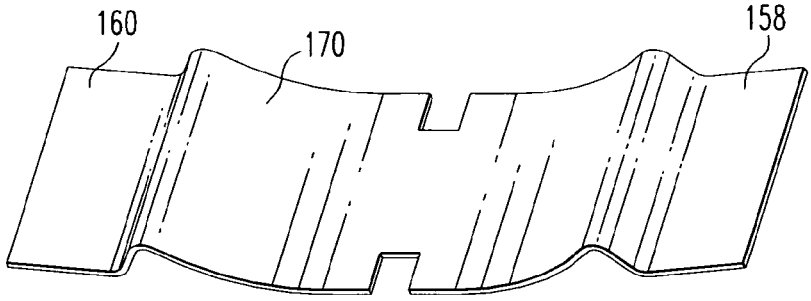
FIG. 14 is a view of a conductor with an integral arcuate segment structured for use in a two position switch.

As shown in FIG. 14, in this embodiment, the arcuate segment 154 is disposed between the conductor first end 158 and second end 160 as a two position integral arcuate portion 170. The integral arcuate portion 170 is shaped as a generally smooth arc. As such, the integral arcuate portion 170 is adapted to be in either one of two position, as shown below. The shape of the integral arcuate portion 170 is a function of the distance between the pivot point 32 and the integral arcuate portion 170, as well as the angular rotation of the handle member 22.

As shown in FIGS. 4–6, when assembled, the conductor 152 is disposed within the enclosed space 15 and the conductor first end 158 is coupled to the first terminal 16. The conductor 152 extends through the yoke 62 towards the second terminal 18. The conductor 152 is shaped so that the movable contact 156 is biased to a first position, wherein the movable contact 156 is spaced from the stationary contact 19. The conductor 152 is sufficiently flexible to allow the movable contact 156 to be moved into a second position, wherein the movable contact 156 engages the stationary contact 19. The integral arcuate portion 170 is disposed within the yoke 62 with the vertex of the integral arcuate portion 170 generally disposed at the yoke 62. In this configuration, the integral arcuate portion 170 may rock from a first position, wherein the integral arcuate portion 170 is tilted toward the first terminal 16, to a second position, wherein the integral arcuate portion 170 is tilted toward the second terminal 18. Because the integral arcuate portion 170 is integral to the conductor 152, as the integral arcuate portion 170 moves between the integral arcuate portion 170 first and second positions, the movable contact 156 is moved between the movable contact 156 first and second positions. That is, as the integral arcuate portion 170 moves, the integral arcuate portion 170 causes the conductor 152 to flex at the yoke 62.

The handle member 22 is coupled to the housing 14 as described above. In this embodiment, however, the piston 44 contacts the upper surface of integral arcuate portion 170. The spring 42 ensures that the piston 44 engages the integral arcuate portion 170. When the handle member 22 is in the first position, the plunger 30 biases the arcuate integral arcuate portion 170 to the integral arcuate portion 170 first position, and therefore the movable contact 156 is in the first position. As the handle member 22 is moved to the second position, the plunger 30 travels over the upper surface of the integral arcuate portion 170 causing the integral arcuate portion 170 to move into the second position. Accordingly, the movable contact 156 is also moved into the second position.

Although the second embodiment was shown as having a fixed end elongated conductor 152, it is understood that the same components, e.g. a two position integral arcuate portion 170, may also be used in conjunction with a rocking conductor 352 that does not include a neutral position portion 371, as described below.

Figure 7:
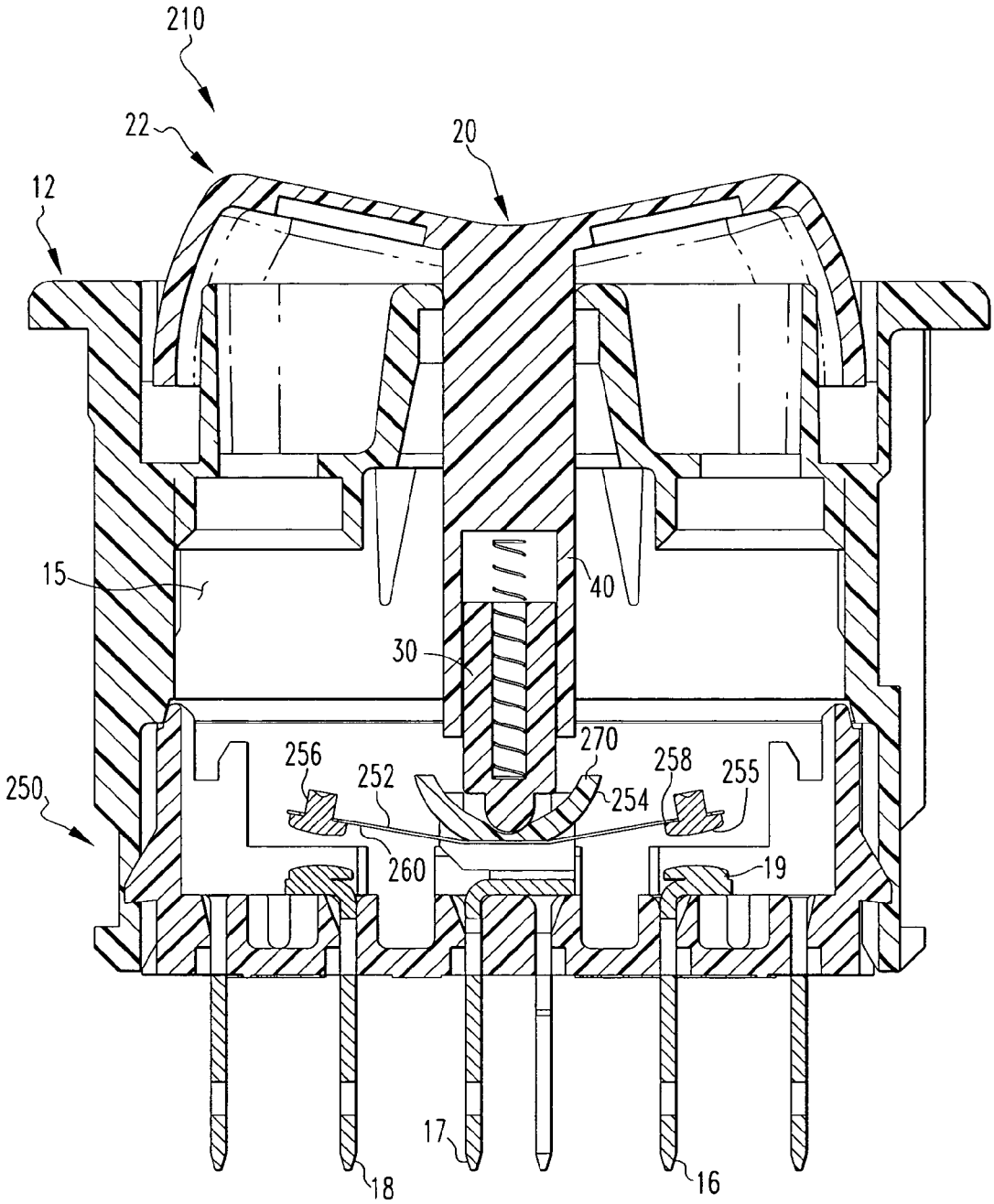
FIG. 7 is cross-sectional side view of a second alternate embodiment of a rocker switch assembly.
Figure 8:
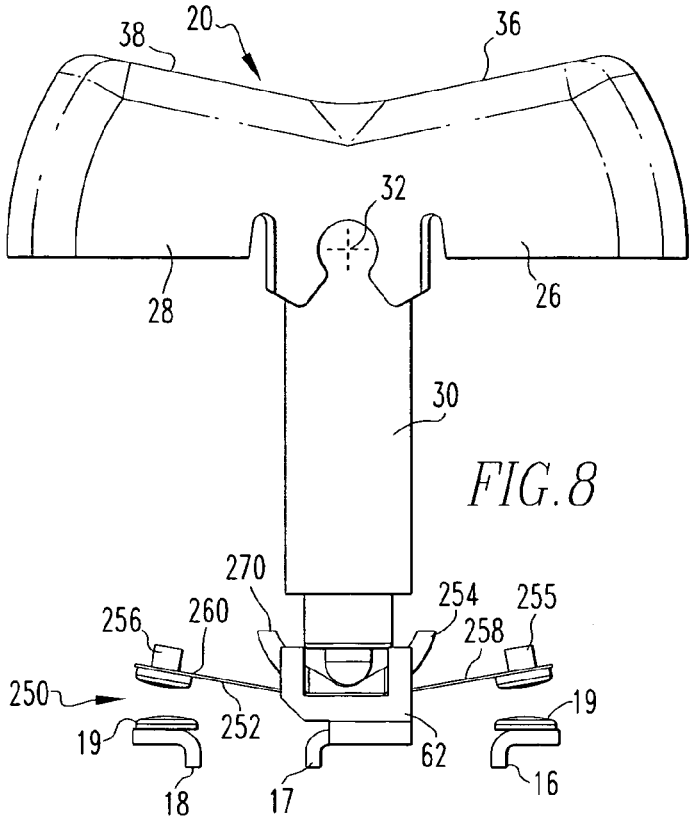
FIG. 8 is a side view of a second alternate embodiment of a handle member and a contactor assembly.
Figure 9:
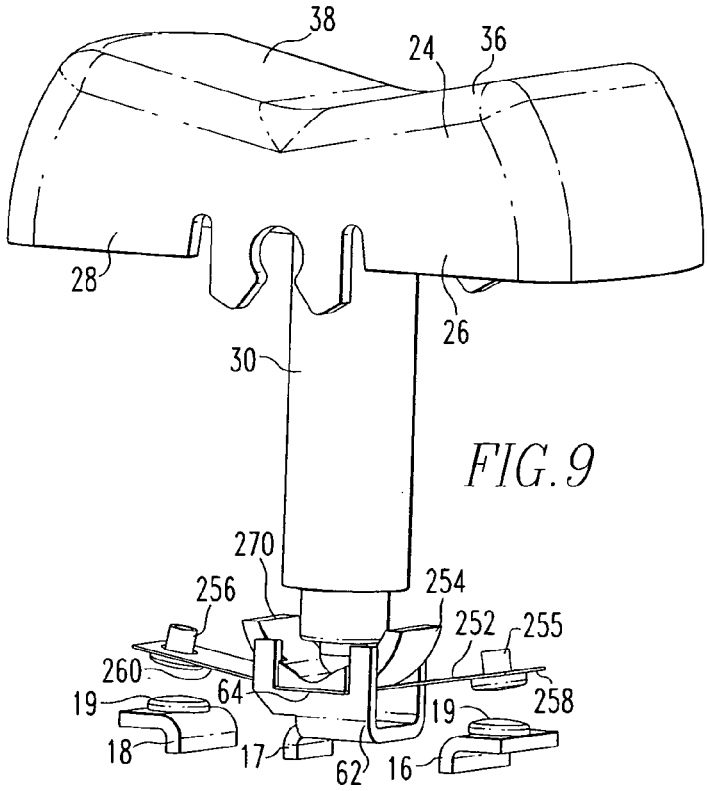
FIG. 9 is an isometric view of a second alternate embodiment of a handle member and a contactor assembly.

A third embodiment of the invention is shown in FIGS. 7–9. Generally, the housing assembly 12 and the handle member 22 are substantially similar to the first embodiment described above. Accordingly, like reference numbers shall be used to identify the components of the housing assembly 12 and the handle member 22 in the third embodiment. Conversely, the contactor assembly 250 is different, but functionally similar. As such, functionally similar components of the contactor assembly 250 shall be identified by reference numbers that have been increased by 200. The primary difference between this embodiment and the first embodiment is that the conductor first end 258 is not coupled to the first terminal 16. As such, the conductor 252 rocks between a first position, a neutral position, and a second position. Thus, in this embodiment the rocker switch assembly 210 is a three-position switch.

Accordingly, in this embodiment, the contactor assembly 250 includes an elongated conductor 252, an arcuate segment 254, a first movable contact 255 and a second movable contact 256. The conductor 252 has a first end 258 and a second end 260. The first movable contact 255 is coupled to the first end 258. The second movable contact 256 is coupled to the second end 260. The conductor 252 is rigid, yet flexible, and is preferably made from copper or a copper alloy. Additionally, the first terminal 16 also includes a stationary contact 19. The conductor 252 is pivotally coupled to the center terminal 17. That is, as shown best in FIG. 9, the center terminal 17 forms a yoke 62 through which the conductor 252 passes, as described below. The conductor 252 contacts the bottom of the yoke 62 at a mounting point 64 and rocks thereon.

Figure 15:
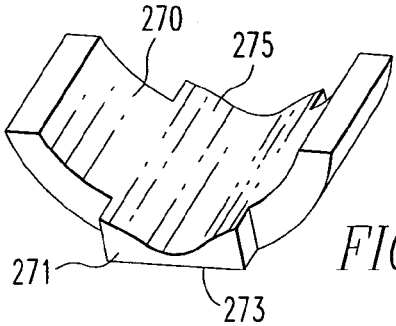
FIG. 15 is a isometric view of an actuator member structured for use in a three position switch.

In this embodiment, the arcuate segment 254 is a three position arcuate actuator member 270, as shown in FIG. 15. The arcuate actuator member 270 is a generally U-shaped having a neutral position portion 271. In this embodiment, the neutral position portion 271 is a flat section 273 on the outer face of the arcuate actuator member 270. Additionally, the inner face of the neutral position portion 271 may include a detent 275 structured to engage the piston 44. As shown in FIGS. 7–9, when installed the arcuate actuator member 270 open side faces toward the plunger 30 and the closed side contacts the conductor 252. The arcuate actuator member 270 is also disposed within the yoke 62. The vertex of the arcuate actuator member 270 is generally disposed within the yoke 62 and the arcuate actuator member 270 is generally symmetrical about the mounting point 64. The shape of the arcuate actuator member 270 is a function of the distance between the pivot point 32 and the arcuate actuator member 270, as well as the angular rotation of the handle member 22.

When assembled, the conductor 252 is disposed within the enclosed space 15. The conductor 252 extends through the yoke 62 with the first end 258 extending towards the first terminal 16 and the second end 260 extending toward the second terminal 18. The conductor first end 258 and the conductor second end 260 are angled upwards relative to the mounting point 64. The conductor 252 is structured to move between a first position where the first movable contact 255 at the conductor first end 258 contacts the stationary contact 19 on the first terminal 16, to a neutral position where neither the first or second movable contacts 255, 256 at conductor first or second end 258, 260 engage a stationary contact 19, to a second position where the second movable contact 256 at the conductor second end 260 contacts the stationary contact 19 on the second terminal 18.

The arcuate actuator member 270 is disposed within the yoke 62 with the vertex of the arcuate actuator member 270 generally disposed at the yoke 62. In this configuration, the arcuate actuator member 270 may rock from a first position, wherein the arcuate actuator member 270 is tilted toward the first terminal 16, to a neutral position where the arcuate actuator member 270 is generally perpendicular to the yoke 62 and the piston 44 engages the detent 275, to a second position, wherein the arcuate actuator member 270 is tilted toward the second terminal 18. Because the arcuate actuator member 270 contacts the conductor 252 at the yoke 62, as the arcuate actuator member 270 moves between the arcuate actuator member 270 first and second positions, the movable contacts 255, 256 are moved between the movable contact 255, 256 first and second positions. That is, as the arcuate actuator member 270 moves, the arcuate actuator member 270 contacts the conductor 252 and causes the conductor 252 to rock at the yoke 62. When the arcuate actuator member 270 is in the neutral position, the conductor 252 is also in the neutral position.

Figure 10:
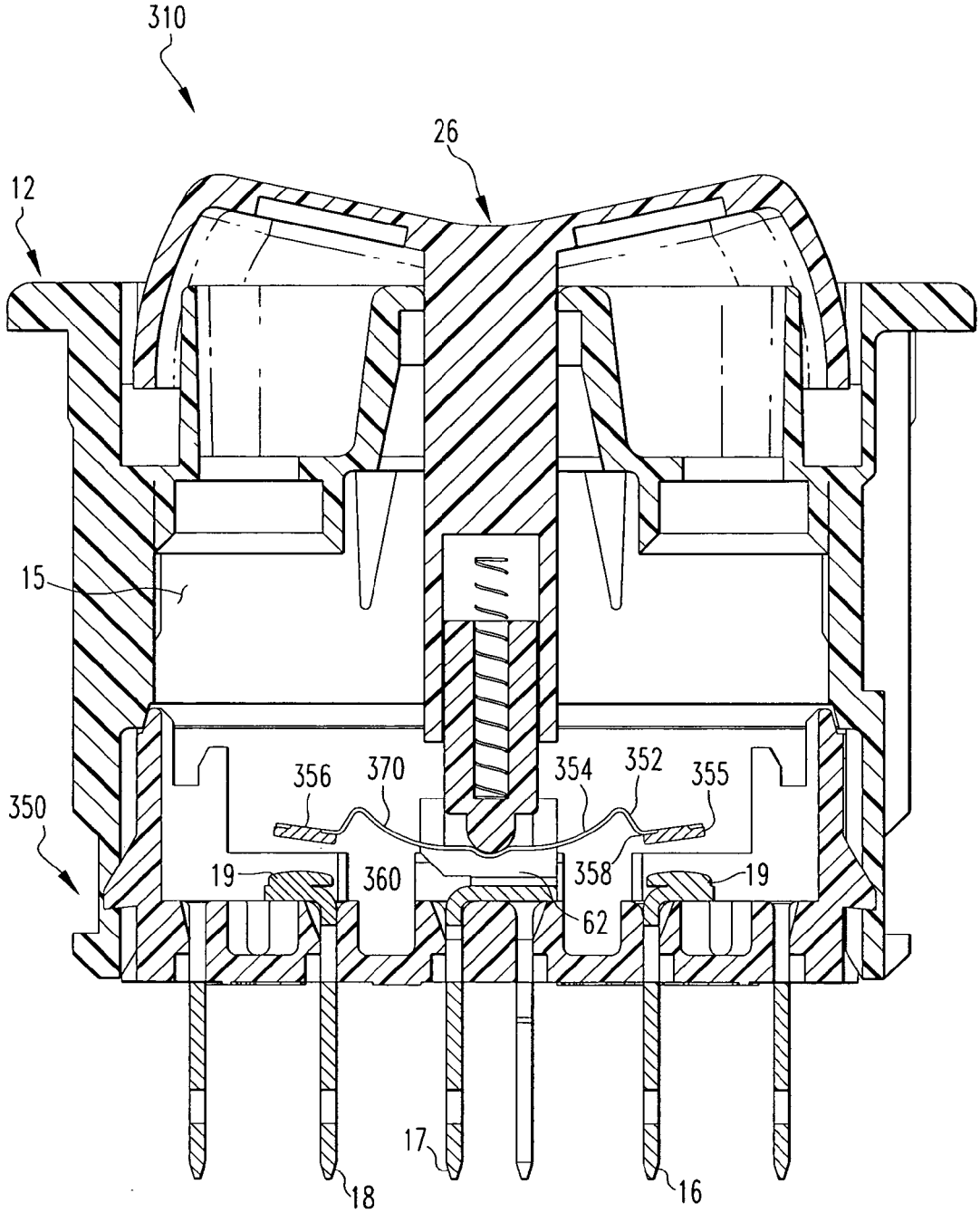
FIG. 10 is cross-sectional side view of a third alternate embodiment of a rocker switch assembly.
Figure 11:
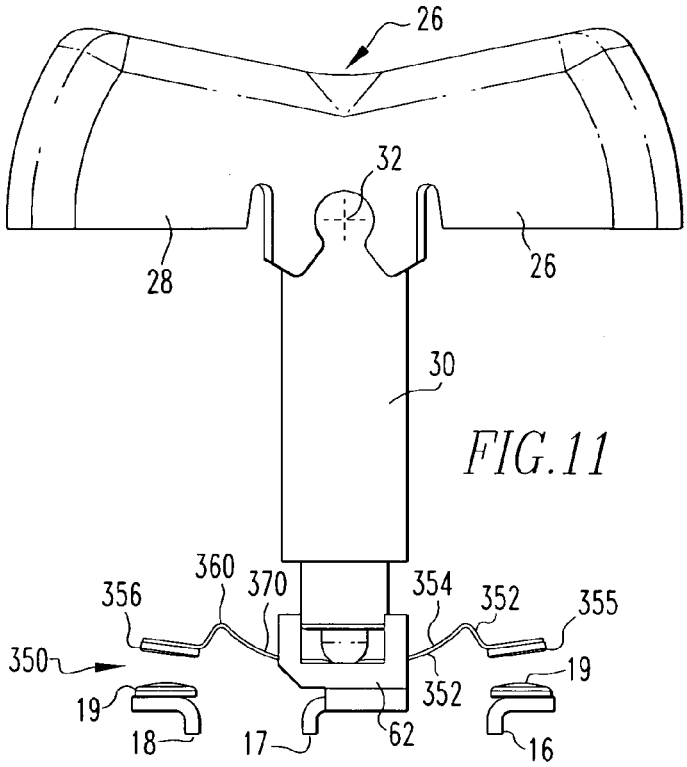
FIG. 11 is a side view of a third alternate embodiment of a handle member and a contactor assembly.
Figure 12:
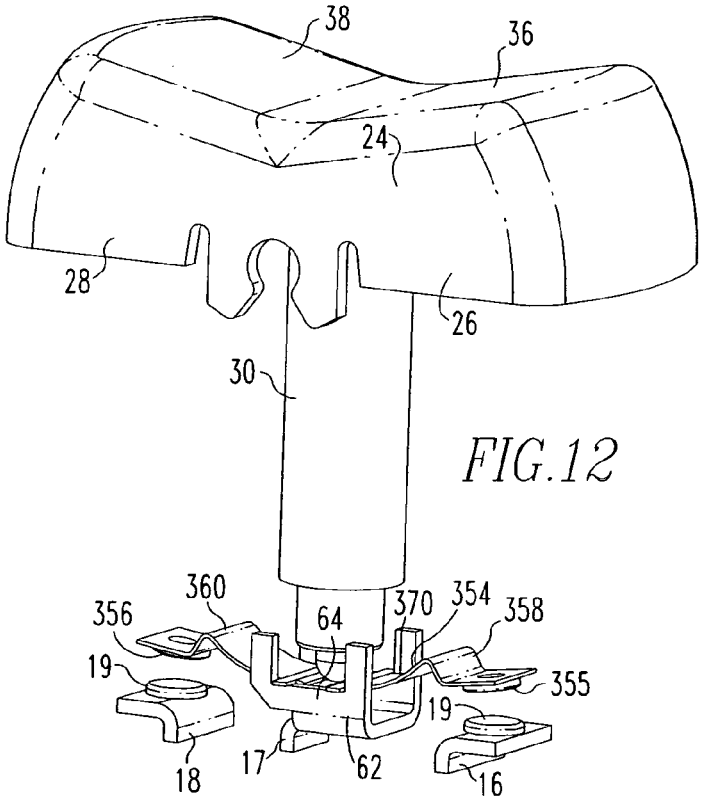
FIG. 12 is an isometric view of a third alternate embodiment of a handle member and a contactor assembly.

A fourth embodiment of the invention is shown in FIGS. 10–12. Generally, the housing assembly 12 and the handle member 22 are substantially similar to the first embodiment described above. Accordingly, like reference numbers shall be used to identify the components of the housing assembly 12 and the handle member 22 in the fourth embodiment. Conversely, the contactor assembly 350 is different, but functionally similar. As such, functionally similar components of the contactor assembly 350 shall be identified by reference numbers that have been increased by 300. The primary difference between this embodiment and the first embodiment is that the conductor first end 358 is not coupled to the terminal 16. As such, the conductor 352 rocks between a first position, a neutral position, and a second position. Thus, in this embodiment the rocker switch assembly 310 is a three-position switch. Additionally, as in the second embodiment, the arcuate segment 354 is integral with the conductor 352.

In this embodiment, the contactor assembly 350 includes an elongated conductor 352, an arcuate segment 354, a first movable contact 355 and a second movable contact 356. The conductor 352 has a first end 358 and a second end 360. The first movable contact 355 at conductor first end is coupled to the first end 358. The second movable contact 356 at conductor second end is coupled to the second end 360. The conductor 352 is rigid, yet flexible, and is preferably made from copper or a copper alloy. Additionally, the first terminal 16 also includes a stationary contact 19. The conductor 352 is pivotally coupled to the center terminal 17. That is, as shown best in FIG. 12, the center terminal 17 forms a yoke 62 through which the conductor 352 passes, as described below. The conductor 352 contacts the bottom of the yoke 62 at a mounting point 64 and rocks thereon.

Figure 16:
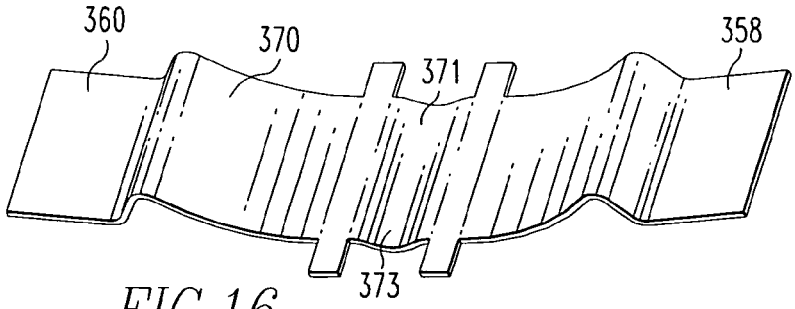
FIG. 16 is an isometric view of a conductor with an integral arcuate segment structured for use in a three position switch.

In this embodiment, the arcuate segment 354 is disposed between the conductor first end 358 and second end 360 as a three position integral arcuate portion 370, as shown in FIG. 16. The integral arcuate portion 370 is shaped as an arc having a neutral position portion 371. In this embodiment, the neutral position portion 371 is a detent 373 structured to engage the piston 44. As such, the integral arcuate portion 170 is adapted to be in one of three positions, as shown below. The shape of the integral arcuate portion 170 is a function of the distance between the pivot point 32 and the integral arcuate portion 170, as well as the angular rotation of the handle member 22.

When assembled, the conductor 352 is disposed within the enclosed space 15. The integral arcuate portion 370 is disposed within the yoke 62 with the vertex of the integral arcuate portion 370 generally disposed at the yoke 62. In this configuration, the integral arcuate portion 370 may rock from a first position, wherein the integral arcuate portion 370 is tilted toward the first terminal 16 so that the first movable contact 355 engages the stationary contact 19 coupled to the first terminal 16, to a neutral position where the integral arcuate portion 370 is generally perpendicular to the yoke 62 and the piston 44 engages the detent 373, to a second position, wherein the integral arcuate portion 370 is tilted toward the second terminal 18 so that the second movable contact 356 engages the stationary contact 19 coupled to the second terminal 18. That is, as the integral arcuate portion 370 moves, the integral arcuate portion 370 contacts the conductor 352 and causes the conductor 352 to rock at the yoke 62. When the integral arcuate portion 370 is in the neutral position, the conductor 352 is also in the neutral position.

While specific embodiments of the invention have been described in detail, it will be appreciated by those skilled in the art that various modifications and alternatives to those details could be developed in light of the overall teachings of the disclosure. For example, in an embodiment where a terminal is not coupled to a load, the terminal may be eliminated and the conductor 52, 152, 252, 352 is coupled to, or contacts, the housing 14. Accordingly, the particular arrangements disclosed are meant to be illustrative only and not limiting as to the scope of invention which is to be given the full breadth of the claims appended and any and all equivalents thereof.

What is claimed is:

1. A rocker switch for a rocker switch assembly, said rocker switch assembly having a housing with terminals, at least one of said terminals having a stationary contact, and defining an enclosed space, said rocker switch comprising:

a handle member structured to be pivotally coupled to said housing at a pivot point, said handle member having first and second extensions extending radially from said pivot point, and a plunger extending generally perpendicular to said first and second extensions and radially from said pivot point;

a contactor assembly having an elongated conductor and a generally arcuate segment;

said contactor assembly disposed within said enclosed space;

wherein said plunger engages said arcuate segment;

wherein said contactor assembly includes a terminal yoke and said conductor is structured to be mounted in said terminal yoke at a mounting point;

wherein said terminals include a first terminal and a second terminal and said at least one stationary contact includes two stationary contacts, one each coupled to said first and second terminals, wherein:

said conductor includes a first end and a second end disposed on opposite sides of said arcuate segment;

said first end having a first movable contact;

said second end having a second movable contact;

said conductor structured to move between a first position, wherein said first movable contact engages said stationary contact coupled to said first terminal and a second position, wherein said second movable contact engages stationary contact coupled to said second terminal; and wherein said actuator member is disposed generally symmetrically about said mounting point.

2. The rocker switch of claim 1, wherein said plunger has a distal end structured to contact said actuator member, the curvature of said actuator member is structured as a function of the length of said plunger between said pivot point and said distal end.

3. A rocker switch assembly comprising:

a housing assembly having a housing defining an enclosed space and a plurality of terminals extending through said housing, said terminals including a first terminal and a second terminal, and a stationary contact coupled to said second terminal;

a handle member structured to be pivotally coupled to said housing at a pivot point, said handle member having first and second extensions extending radially from said pivot point, and a plunger extending generally perpendicular to said first and second extensions and radially from said pivot point;

a contactor assembly having an elongated conductor, a movable contact disposed on said conductor, and a generally arcuate segment;

said contactor assembly disposed within said enclosed space and coupled to said first terminal with said movable contact structured to move between a first position, wherein the movable contact is spaced from said stationary contact and a second position, wherein the movable contact engages said stationary contact;

wherein said plunger engages said arcuate segment;

wherein said contactor assembly includes a terminal yoke and said conductor is structured to be mounted in said terminal yoke at a mounting point;

wherein said arcuate segment is an arc shaped actuator member, said actuator member disposed between said plunger and said conductor;

said first terminal includes a stationary contact;

said conductor includes a first end and a second end disposed on opposite sides of said arcuate segment;

said first end having a first movable contact;

said second end having a second movable contact;

said conductor structured to move between a first position, wherein said first movable contact engages said stationary contact coupled to said first terminal and a second position, wherein said second movable contact engages said stationary contact coupled to said second terminal; and wherein said actuator member is disposed generally symmetrically about said mounting point.

4. The rocker switch assembly of claim 3, wherein said plunger has a distal end structured to contact said actuator member, the curvature of said actuator member is structured as a function of the length of said plunger between said pivot point and said distal end.

* * * * *